United States Patent [19]

Cross et al.

[11] 4,010,727

[45] Mar. 8, 1977

[54] INTERNAL COMBUSTION ENGINE

[76] Inventors: Michael Ellison Cross, 52 Bloomfield Avenue; Albert Edward Coles, 366 Bloomfield Road, both of Bath, England

[22] Filed: Sept. 6, 1974

[21] Appl. No.: 504,689

[30] Foreign Application Priority Data

Sept. 7, 1973 United Kingdom ..... 42104/73

[52] U.S. Cl. ..... 123/190 DL; 123/190 B; 123/190 E; 251/315

[51] Int. Cl.² ..... F01L 7/00

[58] Field of Search ..... 123/190 DL, 190 E, 190 R, 123/190 B, 80 R; 277/134, 167; 251/315, 316, 317

[56] References Cited

FOREIGN PATENTS OR APPLICATIONS 423,474 2/1935 United Kingdom ..... 123/190 E 451,917 8/1936 United Kingdom ..... 123/190 E

*Primary Examiner*—Wendell E. Burns
*Assistant Examiner*—David D. Reynolds
*Attorney, Agent, or Firm*—Emory L. Groff, Jr.

[57] ABSTRACT

An internal combustion engine having a rotary valve for controlling the inlet of fuel and exhaust of combustion products from the engine arranged to supply copious lubrication to the valve face and to remove excess lubricant before the valve registers with the combustion chamber inlet to leave a lubricant film of thickness not exceeding 40 to 50$\mu$ inches, the lubricant flowing through a series of concentric sealing rings, or a spiral groove in the valve housing or the valve surrounding the area of register of the valve opening into the combustion chamber.

3 Claims, 29 Drawing Figures

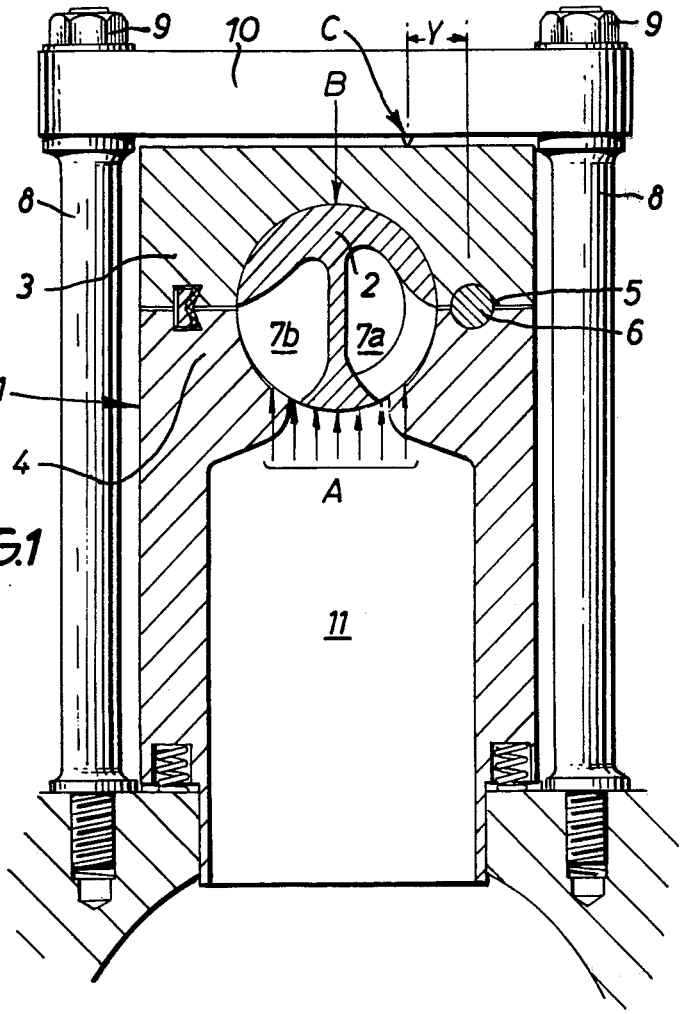
FIG.1
FIG.2
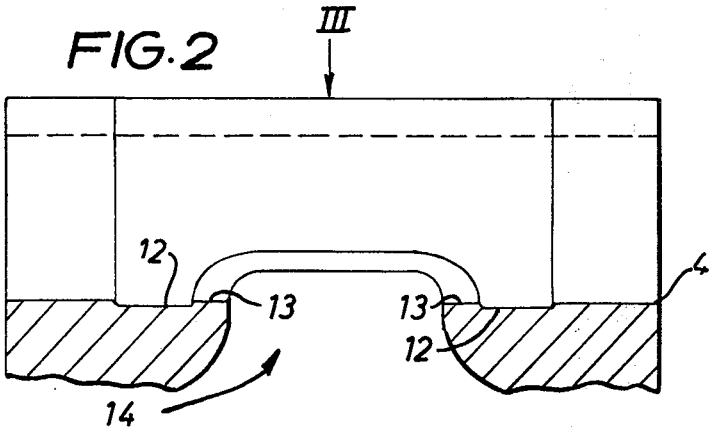

FIG.7
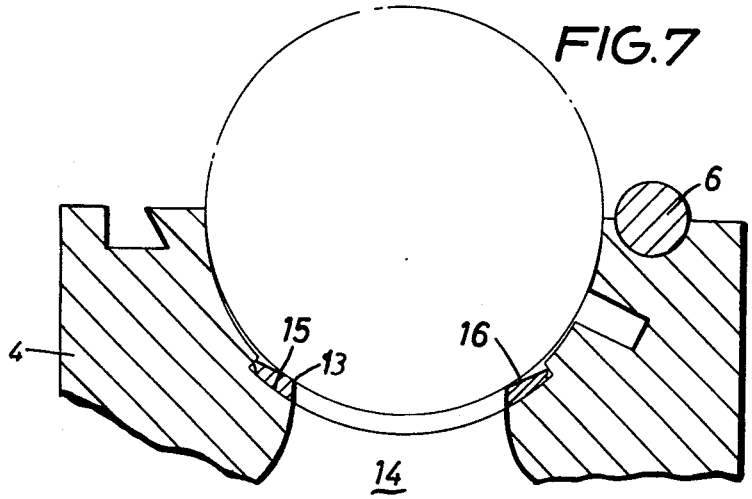
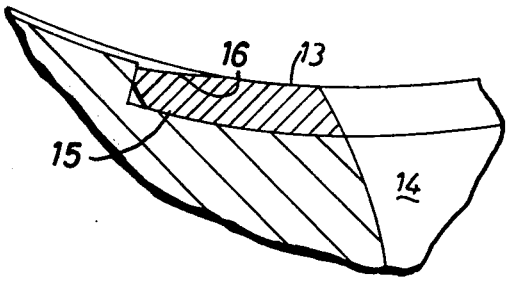
FIG.8
FIG.9
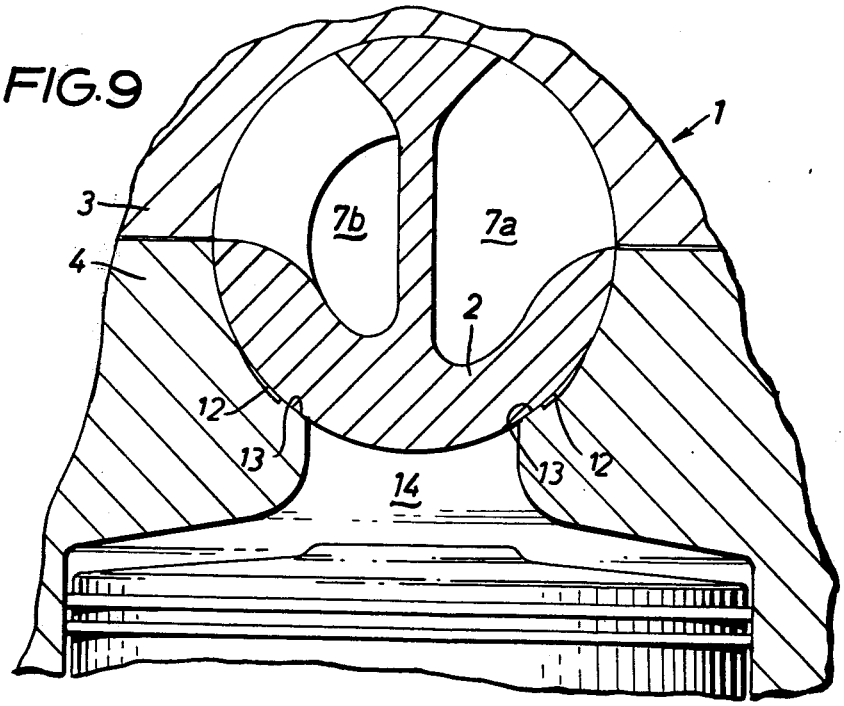

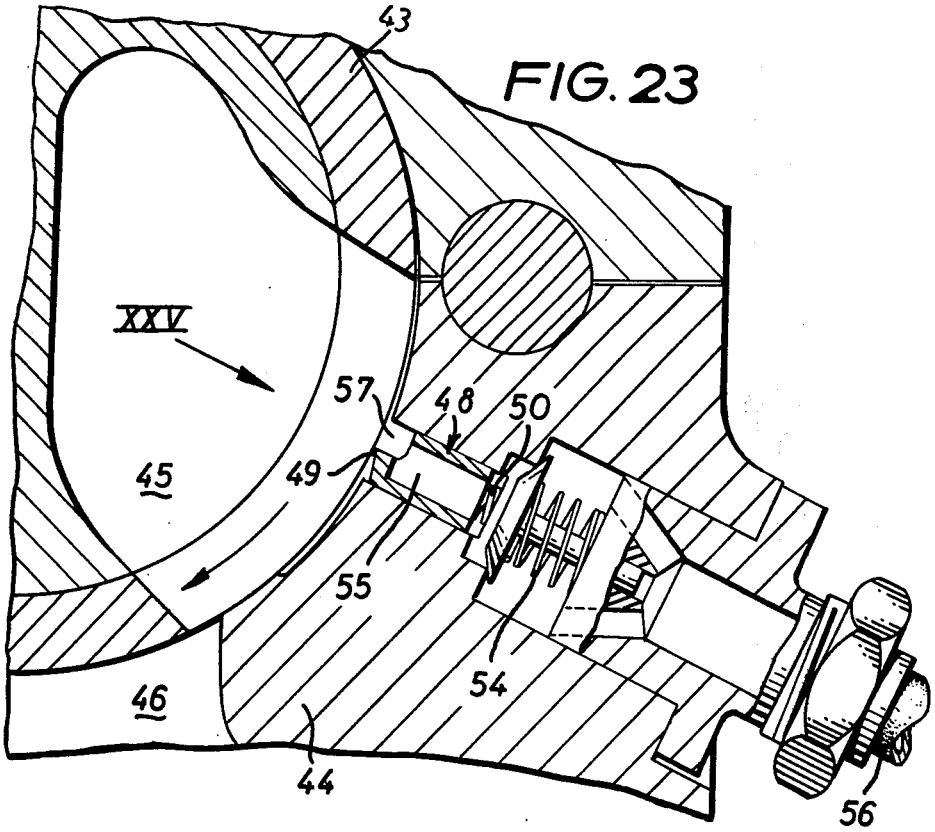
FIG. 23
FIG. 24
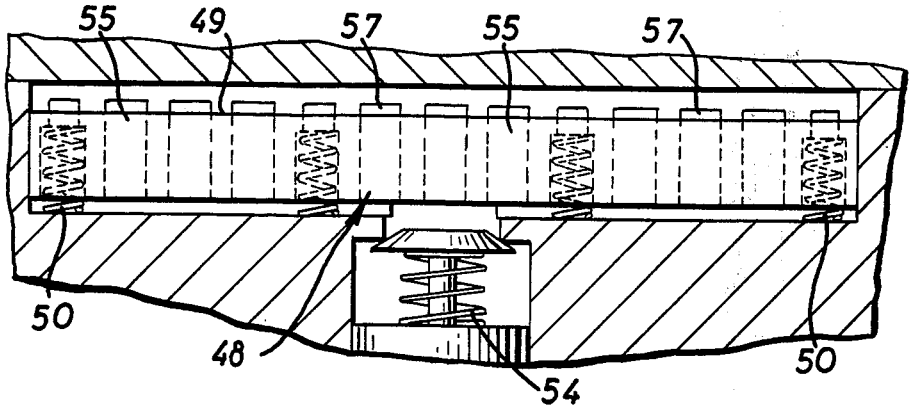

INTERNAL COMBUSTION ENGINE

This invention relates to an improved method and means for the combustion of fuels, and especially hydrocarbon fuels. The invention, although not limited thereto, is particularly applicable to the combustion of fuels in internal combustion engines, and thus relates also to an improved engine for their combustion.

It has long been found essential to provide fuels containing anti-knock additives, usually in the form of alkyl lead compounds, such as tetraethyl lead, tetramethyl lead, or mixtures of these, for internal combustion engines, and as the compression ratios of engines has increased fuels of higher octane numbers (usually expressed as Research octane number, but also as Road or Motor octane number) have been required. Conventional fuels for internal combustion engines nowadays usually have octane numbers above 90, and generally in the region of 100. This necessitates the employment of increased amounts of anti-knock additive, usually in the form of organic lead compounds and of special blends of saturated, unsaturated and aromatic hydrocarbons as fuels. These fuels are comparatively expensive to prepare and contribute significantly to pollution of the atmosphere, particularly because of their lead content — much of which is emitted through the exhaust — and also, apart from noxious products of combustion, because significant amounts of unburnt hydrocarbons are emitted to the atmosphere owing to the inefficient cycle of combustion in the generally-used poppet valve internal combustion engine, allowing some hydrocarbon fuel to pass directly from inlet to exhaust. The problem of atmospheric pollution from internal combustion engines, particularly in automobiles, is concerning the authorities in the major industrial countries and steps are already being taken in some of them to legislate against the use of lead anti-knock additives. Although substitutes for lead have been investigated, they are not particularly satisfactory and generally require to be used in comparatively large quantities; they also increase the cost of the fuel.

As previously mentioned, internal combustion engines, particularly for automobiles, almost without exception employ poppet valves. Poppet valves obstruct the combustion chamber as do the valve clearance pockets which are generally necessary in the top of the pistons. Furthermore, the construction of a poppet valve engine is such that there is necessarily a significant degree of overlap when the inlet and exhaust valves are both open, whereby some unburnt fuel may pass directly from the inlet port to the exhaust port and thence to the atmosphere. These adverse features are aggravated in engines of high compression ratios, such as 9:1 to 12:1 and bore/stroke ratios exceeding 1:1, such as from 1.5:1 to 3:1.

Certain recent developments, such as the "Wankel" engine propose a departure from the conventional poppet valve engine, and incorporate good volumetric efficiency and potentially low surface temperatures, since they do not contain exhaust valves as such. However, these engines invariably incorporate internal sealing devices which cannot be lubricated with re-circulated oil, and oil that is required for their lubrication is supplied on a constant loss basis; most of the oil burns and passes out through the exhaust thus aggravating the problem of atmospheric pollution. Furthermore, in burning, the oil gives rise to surface deposits in the combustion chamber, resulting in low rates of thermal conductivity and variable mechanical strength. This can give rise to incandescence, so that the use of anti-knock additives such as the objectionable lead alkyls, must be maximised instead of minimised and, of course, the oil consumption of the engine is increased. As will be seen from the description of the present invention, which follows hereinafter, an engine of the present invention avoids the use of sealing elements from which lubricant cannot be recovered by suitable means virtually to the degree of that of the conventional Ramsbottom piston ring used to seal reciprocating pistons. Indeed, an engine of this invention is believed to be unique amongst non-poppet valve engines in its ability to recover sealing lubricant to a degree comparable to that of a reciprocating piston engine.

The present invention is based on the principle of the Cross rotary valve engine as referred to by the inventor, R. C. Cross, in his address to the general meeting of the Automobile Division of the Institution of Mechanical Engineers on Oct. 8, 1957, and published in the Institution's Transactions.

The rotary valve discussed in this invention is a development of the original Cross rotary valve as referred to in the above mentioned Transactions, and employs special features for sealing the valve ports, special methods for providing lubrication and, preferably, a controlled loading on the valve. According to preferred features of this invention, the valve may have a spherical, or part-spherical, shape or the shape of a segment of a sphere. These features improve the effectiveness of fuel combustion, improve lubrication and enhance the compression effect. It has been found that the rotary valve engine of the invention allows the use of a high compression ratio without having to resort to high octane fuels, due at least in part to the substantially unobstructed combustion chamber.

The invention is not limited to the combustion of fuels in machines equipped with reciprocating pistons, and certain types of rotary piston machines — such as the Codey, having a clover leaf cylinder, and the epitrochoid, as in the Wankel engine — can employ a separate valving arrangement, in which case the invention could be applied thereto. This is of particular importance in high pressure machines, or where the local heat flux imported to the area of the working cylinder would be excessive if rotary piston seals were interrupted by porting, as in the Wankel engine where melting can occur.

Combustion is particularly effective in engines of the invention with compression ratios of, for example, 10.5:1 and bore/stroke ratios of 1.5:1 to 3:1, in contrast to conventional poppet valve engines. A conventional poppet valve combustion chamber generally has two valve ports in the cylinder head, which can be opened and closed by mushroom-shaped circular poppet valves. To obtain a combustion chamber of a given compression ratio and minimum charge depth, the distance over both valves does not usually exceed the bore of the cylinder. This is of significance in terms of effective area; geometrically it would be possible to accommodate valves each having an area of 25% of the cylinder bore area in a two valve, co-planar layout. However, in practice, the supporting metal around the valve seat reduces this to 18% or less. It is, of course, possible to incline the axes of operation of the valves and obtain some increased area, but the limit is reached at about 90° between the valve axes and the area is then about 24% of bore with two valves, or 26% with four smaller valves. The best compromise is where there is one large inlet valve and two small exhaust valves, and then up to 30% may be obtained, but the driving mechanism of this three valve layout is complicated. Attempts have been made to avoid the area limitation of poppet valves, such as those proposed by Bucchi about 1953, which employed concentric poppet valves for both inlet and exhaust, but these proposals have never been very successful.

In the arrangement of the present invention, with a single cylinder port and a rotary cylindrical valve member, provides much larger areas than is possible with poppet valves, since there is only one breach into the combustion chamber. Furthermore, since the cylinder port can be square, the possible maximum theoretical area of the port is related directly to the area of a square fitting within the circumscribing bore. In this case the port area may increase in direct proportion with bore diameter, which generally is increased with stroke, so that the valve area of a large engine can be kept in step with the cylinder volume — unlike a poppet valve system in which the effective valve area can increase in step with bore area only. In practice, a reasonable combustion chamber depth can be achieved with the present invention with a port area of up to 36% of bore area.

Owing to inertia, a poppet valve cannot be opened fully or closed completely in much less than 100° of crankshaft rotation in a high speed engine; to avoid undue forces in the valve gear, the opening diagram shows a nearly sinusoidal curve, that is, at about 50% opening, the available area is 50%. In order to open and close poppet valves so that the maximum opening coincides with cycle requirements, both valves are open together at top dead centre at the end of the exhaust stroke, and this leaves a clear path for unburnt fuel to flow from the inlet port to the exhaust port. The valve of the present invention does not suffer substantially from this defect and can be arranged to have no, or very little overlap. This is because the valve ports can be opened and closed fully in as little as 25° of crankshaft rotation.

In one aspect of this invention, there is provided a method of enhancing the performance of internal combustion engines wherein the admission of combustible mixture to the combustion chamber, or chambers, of an engine and the removal of combustion products therefrom, is controlled by a rotary valve wherein a copious amount of lubricant is supplied to the interface between the valve member and the valve housing at a position so as to lubricate the valve member as it rotates after it has passed the opening into the combustion chamber and excess lubricant is removed from the valve member before lubricant can be carried by valve member rotation into the combustion chamber such that the residual lubricant remaining on the valve member has a film thickness of 40–50$\mu$ in., so as to be physically attracted by surface irregularities of the valve member.

In another aspect, this invention provides special seals to seal the valve member port when it is in communication with the opening to the combustion chamber. To this end, there is provided a rotary valve adapted to control the inlet of combustible mixture to, and exhaust of combustion products from, a combustion chamber, which valve comprises a valve housing having an opening communicating with the combustion chamber and a valve member rotatably mounted within the housing, there being upstanding lips provided within the housing around the opening to engage with and effect a seal against the rotatable valve member.

The function of the lips is to seal the valve housing to the valve member in the region of the opening, whereby the ingress of lubricant to the combustion chamber of an engine can be significantly reduced and whereby more efficient combustion of fuel in the combustion chamber can be achieved, with a consequent reduction of the emission of unburned, or incompletely burned, fuel through the exhaust system.

The sealing lips may be provided in various ways. For example, the valve housing may be relieved at an appropriate position around but spaced from the opening into the combustion chamber to leave unrelieved parts forming the lips about the opening. Alternatively the housing may be relieved around the opening, and one or more inserts fitted within the relieved part to constitute the lips. In either form of the invention, the lips may upstand by the greatest amount immediately adjacent the opening, and opening to the combustion chamber.

In the areas away from the lips, the housing should be formed — for example by machining — to provide a close running fit on the valve member. The lips should upstand from the housing by from 1/300 to 1/1000 of the diameter of the valve member in order to obtain the optimum sealing. The width of the sealing lips may vary widely to suit varying engine conditions; however, it is preferred that the arrangement is such that the bearing pressure on the lips is in the range of 500 to 1000 lbs/sq. inch. These loads are particularly suitable when the portion of the valve member which runs on the lips is made of nitricast iron or hardened steel. In this case the housing should be selected from a compatible metal or metal alloy, such as an aluminium alloy, brass, bronze, tin or white metal.

The lips allow there to be a substantially no-clearance seal between the valve member and the lips relying upon a very thin film of lubricant therebetween, falling within the realms of elastohydrodynamic lubrication theory. The precise minimum thickness of such a film is within the range of surface asperity heights, and it is found that, in accordance with the formula set out below of Dowson and Higgenson, the actual minimum film thickness obtainable, for diameters of valve members which have thus far been used is of the order of 40 to 50$\mu$ in. (i.e. 1.00 to 1.25$\mu$ m.). This minimum film thickness can be calculated from the dimensionless film thickness parameter H, and a knowledge of the valve member diameter.

The surface area of the lips found necessary for such a film to be established may be determined in practice by assuming the reaction force to be evenly distributed over the entire sealing area of the lips. The value of the force can then be expressed as a nominal projected surface pressure, to enable the use of a practical rule of loading to cover a wide range of valve diameters and opening areas. A practical nominal unit pressure may suitably be within the range of 500 to 1000 lbs/sq. inch, as previously mentioned.

Alternatively, or in addition, to the foregoing lips, a seal may be formed by providing sealing means in the rotary valve member. For a cylindrical rotary valve, which comprises a stationary valve housing having an opening into the combustion chamber in a face thereof, and a cylindrical valve member having a face slidable over the said face of the housing and having a port in its said face which comes into and out of communication with the opening, the preferred form of sealing means comprises at least two circumferential sealing rings mounted in the valve member, one on each side of the port therein for sealing against the said face of the valve housing. Additionally, there should be at least two sealing strips disposed in the valve member parallel to its axis of rotation, one on each side of the port in the valve member, for sealing against the said face of the valve housing. In this way, the port in the valve member is surrounded by sealing strips, and if required, these can be resiliently urged outwardly to bear on the said face of the valve housing.

An alternative arrangement is for there to be provided one or more sealing elements around the opening in the said face of the valve housing, for sealing against the valve member. Although this could be applied to a cylindrical rotary valve, it finds particular use in connection with a rotary valve having a spherical, or part spherical valve member. In a similar way, sealing elements could instead be provided around the port in the said face of the valve member, for sealing against the valve housing.

In either case in which sealing elements are provided, the or each element may comprise a volute or spiral groove formed in the said face, or in an insert fitted into the said face. Instead of a single groove, a series of concentric grooves may be formed in the said face or in an insert fitted into the said face. Although the sealing may be accomplished simply by the effect of the upstanding parts of the element between the grooves, it is preferred for there to be one or more sealing strips fitted into the or each groove to effect the seal, and such strips may be resiliently urged into engagement with the face against which it is to effect the seal, as necessary to form an effective seal. For the case of a spherical valve member, such a strip is advantageously co-planar when relaxed, and is deformed from its relaxed state when the valve member is fitted into the housing; this deformation can provide the resilient bias on the strip.

The sealing arrangements using volutes or spirals are of advantage with very high cyclic cylinder pressures. Unlike a series of concentric rings, which produce a labrynthine effect and consequent time lag for each successive pulse of pressure in successive rings, a volute or spiral seal provides a small but continuous leak path. The effect of this arrangement is to develop a viscous pressure drop along the entire length of the seal.

The seal between the valve and the combustion chamber is enhanced by maintaining very thin lubricant film, the sealing means serving to prevent lubricant being carried in a relatively thick layer on the valve member surface past the opening in the housing. This has the advantages that because a very thin film of lubricant follows the valve member temperature more closely than that of the gas passing through the valve, it therefore does not become materially oxidised or carbonised. Furthermore, the lubricant film is so thin as to be physically attracted by the surface irregularities of the valve and is thus not liable to be scraped off into the combustion chamber when passing the opening. The precise minimum thickness is within the range of surface asperity heights, and thus the film falls within the theory of elastohydrodynamic lubrication, mentioned above. Because the oil film is so thin as to be physically attracted by the surface irregularities of the valve, it is thus not liable to be scraped off into the combustion chamber in passing the cylinder opening.

The rotary valve employed in the invention may be provided with copious lubrication, e.g. 10 to 20 times a generally accepted amount, and excess lubricant removed during the operation of the valve to provide the elastohydrodynamic regime aforementioned, by providing means to supply copious lubrication to the valve housing and hence on the valve member, and means to remove excess lubricant at an appropriate position in the travel of the valve member. The provision of copious lubrication at the relevant position assists in cooling the valve and also in achieving high compression ratios without knocking on comparatively low octane rating fuels; such ratios on low octane fuels are not possible in poppet valve engines owing to the high running temperature of the exhaust valve. Sufficient cooled and filtered oil is also required to effect the necessary exchange of lubricant in the thin film actually carried past the opening during combustion. Oil for the thin film needs to be constantly changed during operation to remove combustion products collected as fine solids on the film; these can be carried to the main oil supply where impurities may be removed by detergents and filtration.

In a preferred arrangement of the lubrication cycle, lubricant is supplied to the face of the valve member through the valve housing, at a position beyond the opening to the combustion chamber, and excess lubricant is removed suitably by means of a scraper device at a position in the valve housing that ensures that the oil film on the valve member is substantially removed before it can be carried by rotation of the valve member into the combustion chamber.

Preferably one or more non-return valves can be associated with the scraper device to ensure that removed oil is drained away therefrom, by creating an area of reduced (i.e. subatmospheric) pressure. The creation of the reduced pressure may be assisted, if desired, by the employment of a vacuum pump.

The scraper device conveniently comprises an essentially rigid scraper blade of greater axial extent than the parts in the valve member, the blade being resiliently pressed, for instance by springs, against the valve member surface from which the lubricant is being scraped. In this way, the edge of the scraper blade is self-bedding against the valve member surface, and if the edge wears the wear will be substantially even and compensated by the resilient pressure applied to the scraper blade. The resilient pressure also enables the scraper blade to adjust itself to thermal expansion in the system in which it operates.

In operation, as the valve rotates the blade itself should not be deflected significantly into a port, and it has been established that the rigidity of the blade coupled with the resilience of the bias, is such that when a port in the valve member is in register therewith, the blade is not deflected into the port by more than 1/3000 (i.e. approximately 0.0003) of the diameter of the valve member.

In the present invention there is preferably a controlled loading on the rotary valve adapted to provide a system wherein a proportion of the combustion force in the cylinder is utilised to provide a self-adjusting, substantially no-clearance seal between the valve member and its housing, without causing excessive strain on the valve driving gear or wear on the valve member and housing bore.

One way of effecting this utilises a valve housing in two parts, the two parts being hinged together. One part, having the opening to the combustion chamber, is attached to or forms a part of the cylinder or cylinder head, whereas the other part is clamped on to the one part by suitable means connected to the engine crankcase. The cylinder itself is spring-urged upwardly away from the crankcase, towards the other part, but may move away from the other part against the spring bias.

When this loading system is applied to this invention, there is a force obtained from the combustion force which acts directly on to the valve member and tends to lift it off the sealing means provided in the one part around the opening. This force (force A) can be expressed as follows:

$$\text{Force } A = \frac{\text{Total combustion force} \times \text{Area over sealing means}}{\text{Cross-sectional area of cylinder}}$$

The reaction to this force is taken by the other part of the valve housing, at a reaction point (point C) spaced from the centre-line of the valve; this generates an opposed force (force B) on the other part of the valve housing urging the valve member back on to its sealing means. By suitable selection of the hinge point of the two parts, and of point C, this force B can be arranged to be 8 to 15% greater than force A, thereby maintaining contact between valve member and the sealing means.

Thus the engines of the invention include a rotary valve provided with inlet and exhaust ports for the admission of fuel to and exhaust of combination gases from the combustion chamber of an internal combustion engine and, in preferred forms, an improved means for and method of sealing the rotary valve from the combustion chamber and an improved means for and method of lubricating the valve. The invention, in its preferred aspects, provides a means whereby compression ratios of 9:1 – 12:1, preferably 10.5:1 may be achieved without engine knocking with hydrocarbon fuels containing substantially less anti-knock additive than is necessary with poppet valve type engines, or even, in some cases, with no anti-knock additive. Thus, an engine in accordance with the present invention of 350 c.c. capacity, when using fuel of 79 octane rating (research) showed superior torque and B.M.E.F. performance to a conventional 350 c.c. poppet valve engine fuelled with 96 octane rating (research) fuel. Fuels of 66 octane rating (research) have been used satisfactorily in engines of the invention. This is due, at least in part, to the geometry of the ports which are open for a time, and to an extent, which is insufficient to permit any significant mixing of unburnt combustible mixture with the exhaust gases in the combustion chamber.

In a further modification of the invention a limited amount of exhaust gas may be re-circulated by admitting a controlled and predetermined amount of hot exhaust gas from the exhaust valve into the combustion space during the intake stroke of the cycle. This may be accomplished by providing a suitably positioned duct to admit exhaust gas from the exhaust duct to the intake of the rotary valve.

The invention is further illustrated, by way of example, with reference to the accompanying drawings, wherein:

FIG. 1 is a vertical section illustrating the principle of controlled loading of a valve and engine cylinder;

FIG. 2 is a part section through the housing of a rotary valve and the top of a combustion chamber of an engine cylinder;

FIG. 7 is a part cross-section of the valve housing shown in FIG. 5;

FIG. 8 is an enlarged detail of part of FIG. 7;

FIG. 9 is a cross-section of part of a rotary valve engine, for comparison with FIG. 10;

FIG. 23 is a section of part of a rotary valve provided with a scraper device and associated non-return valve;

FIG. 24 is a longitudinal section of the scraper device of FIG. 23;

Figure 3:
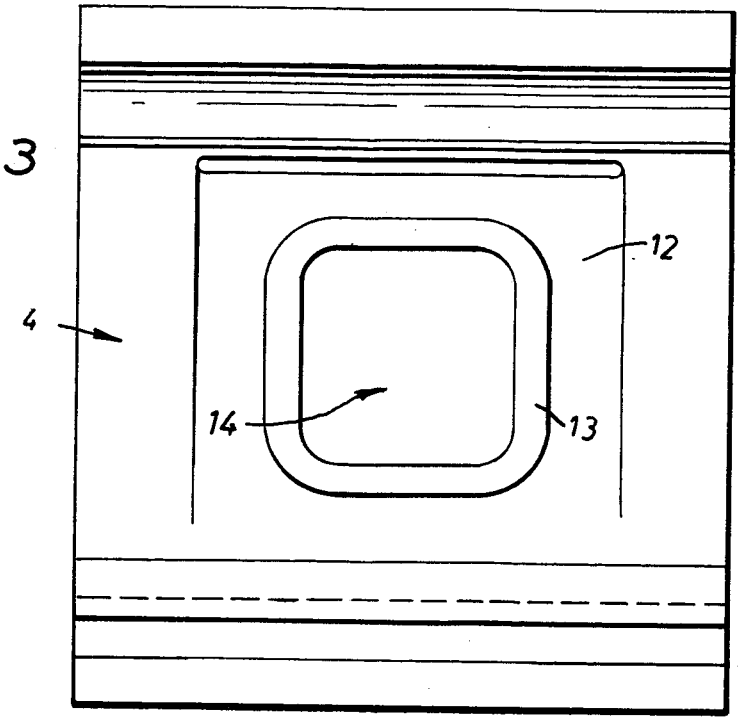
FIG. 3 is a plan view on arrow III on FIG. 2.

Referring to FIG. 1 of the drawings, there is shown a part of a reciprocating piston engine having a rotary valve comprising a valve housing 1 split diametrically into two parts 3 and 4, and a valve member 2. The upper, cap part 3 of the housing is hinged at 5 about a pin 6 to the lower, base part 4. Two pillars 8 are threaded at one of their ends into the engine crankcase, and at their other ends support a cross beam 10 by means of nuts 9. The beam 10 bears on the upper part 3 of the valve housing at C, to take the reaction from the combustion within the engine. The engine cylinder is mounted in the crankcase so as to be able to move along its own axis, and is biassed by suitable springs towards the cross beam 10.

When the engine runs, the combustion force developed in the cylinder produces a force A tending to lift the valve member off its seating on the lower part 4 of the housing. The reaction to this force A is taken at C on the cross beam, and the precise position of point C is selected to be a distance Y from the hinge 5 centre line, so that, by the principle of moments, the downward force B, regarded as being applied at the vertical centre line of the valve member 2, exceeds the upward force A to prevent the valve member being lifted off its seating. The position of C should be selected such that force B exceeds force A by 8 to 15%.

Figure 4:
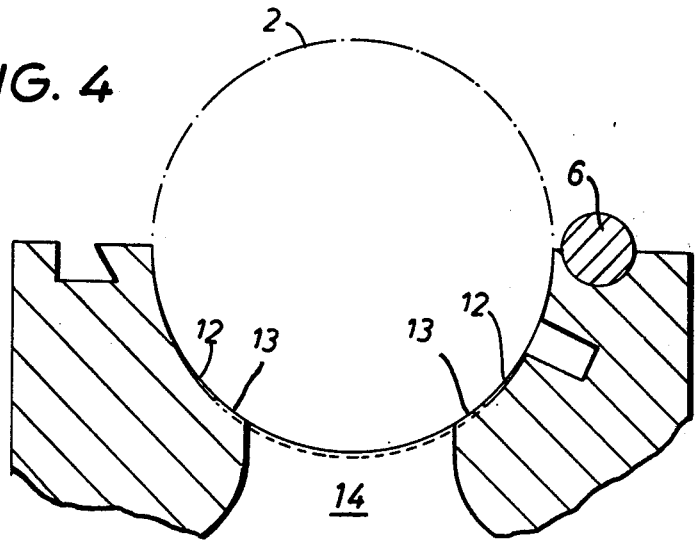
FIG. 4 is a part cross-section of the valve housing shown in FIG. 2.
Figure 5:
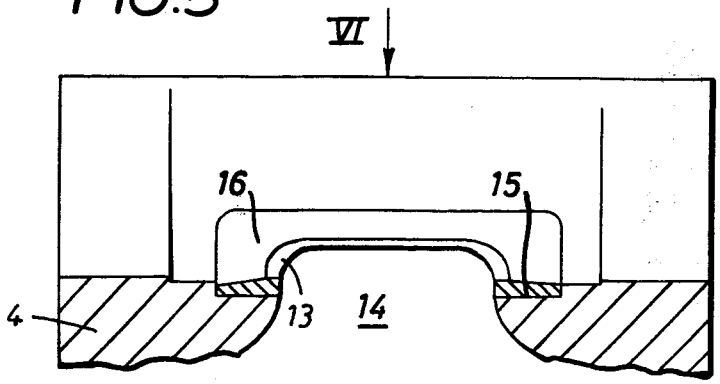
FIG. 5 shows an alternative construction of valve housing to that shown in FIG. 2.
Figure 6:
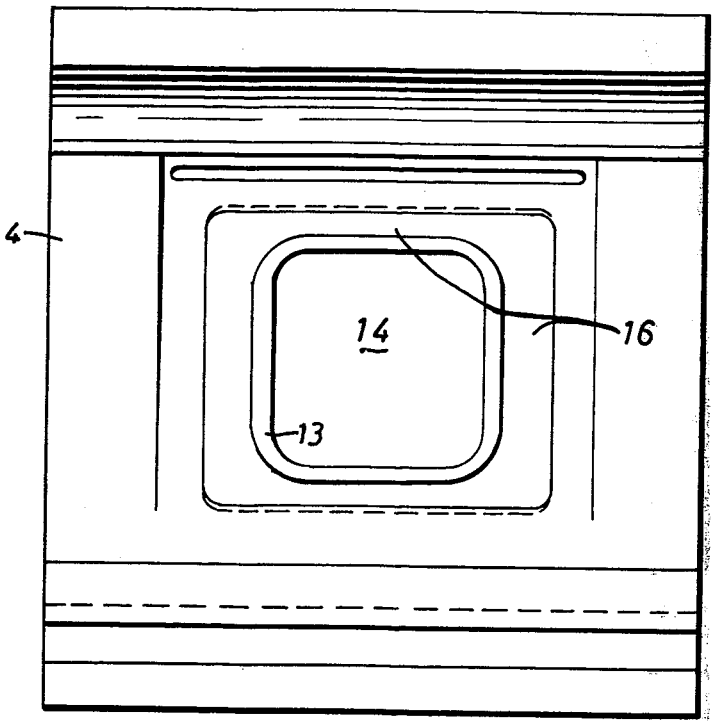
FIG. 6 is a plan view on arrow VI on FIG. 5.

As can be seen from FIGS. 2, 3 and 4, the lower part 4 of the valve housing 1 is relieved, as shown at 12, to provide sealing lips 13 about the opening 14 in the housing to the combustion chamber of the cylinder 11; these lips provide a seal between the valve member 2 and its housing, and in particular between a port 7*a* or 7*b* and the combustion chamber when one of the ports in the valve member is in communication with the opening 14.

FIGS. 5 to 8 show an alternative form of seal, wherein sealing lips 13 are provided by inserts 15 fitted into a relieved area 12 of the lower part 4 of the housing 1 around the opening 14. The insert is bevelled at 16, as shown.

In either form of the lips, they should be arranged to upstand by from 1/300 to 1/1000 of the rotor diameter.

Figure 10:
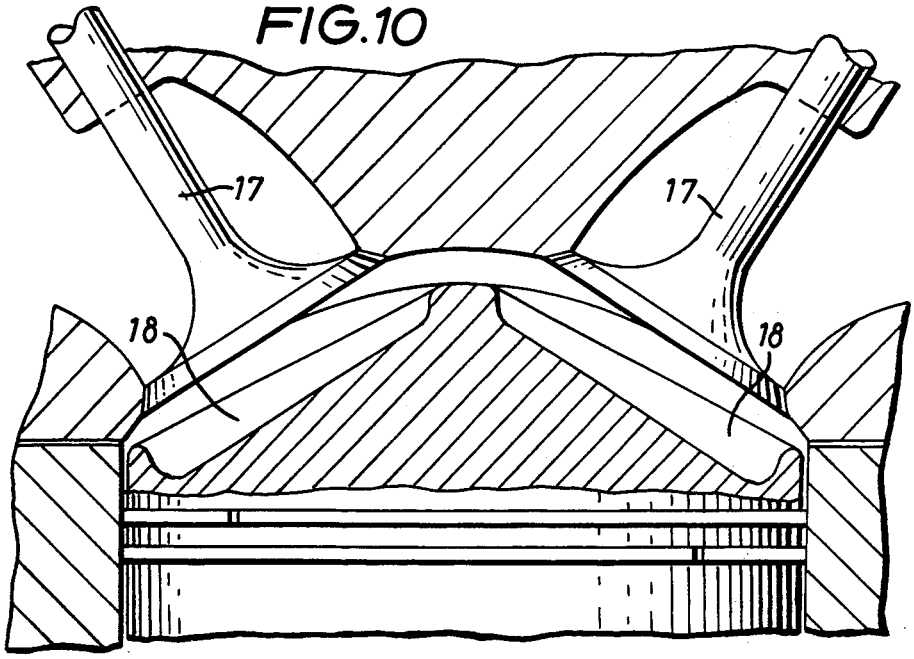
FIG. 10 is a cross-section of a part of a poppet valve engine.
Figure 11:
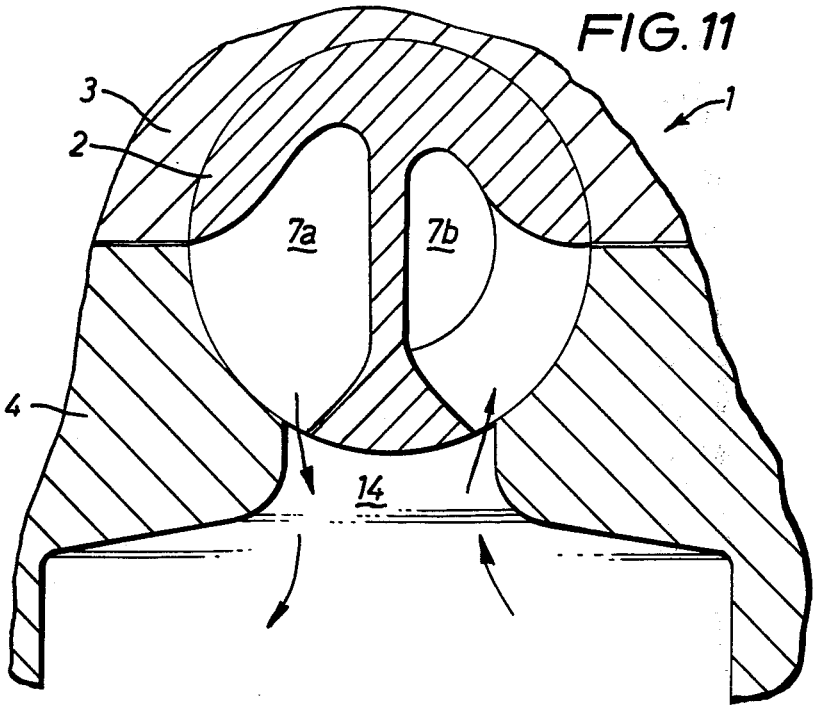
FIG. 11 is a schematic detail drawing of part of a rotary valve engine, showing the flow of inlet and exhaust gases.
Figure 12:
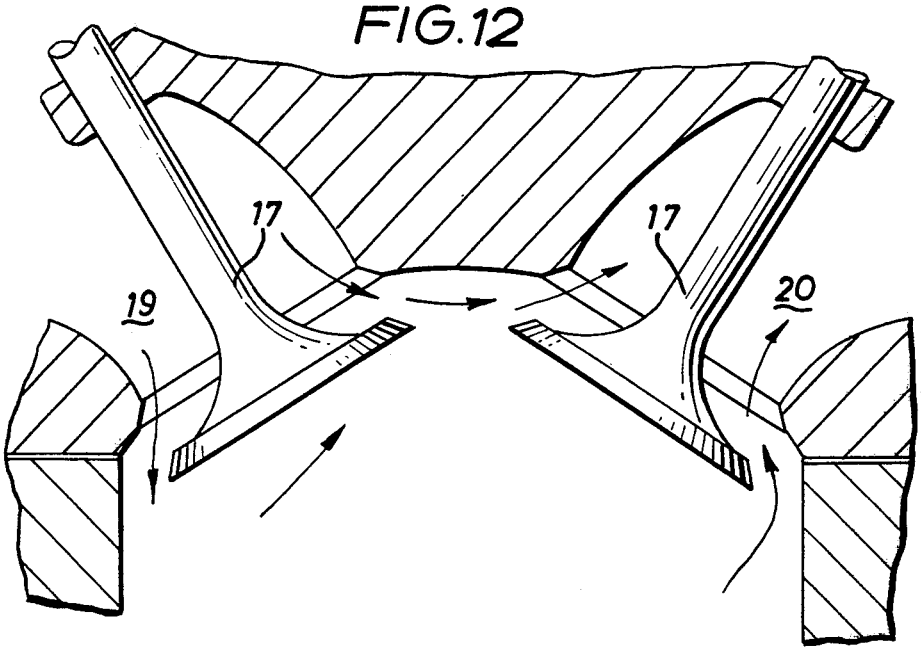
FIG. 12 is a comparative schematic detail drawing of part of a poppet valve engine, showing the flow of inlet and exhaust gases.
Figure 13:
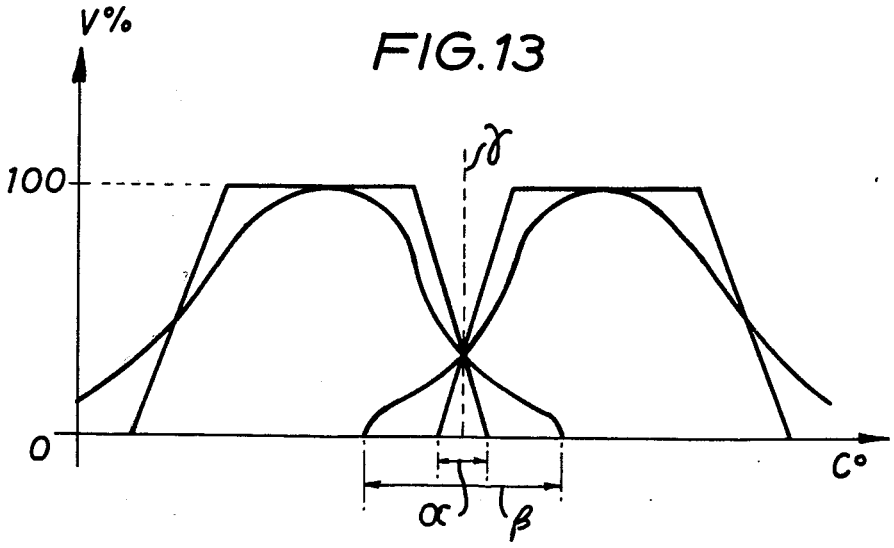
FIG. 13 is a graph comparing the operation of a rotary valve with poppet valves.

By comparing FIG. 9 (part of a rotary valve engine) with FIG. 10 (part of a poppet valve engine), it can be seen that the rotary valve member does not obstruct the combustion chamber in the same way that poppet valves 17 do; furthermore, the flow of gases in a poppet valve engine is impeded by valve clearance pockets 18 which are often provided in the top of the piston. The superiority of combustion in a rotary valve engine, compared with a poppet valve engine, is illustrated by reference to FIGS. 11 and 12, in which the separation of the inlet and exhaust gas flow is compared. In the rotary valve engine, the opening and closing of the inlet and exhaust ports is markedly faster than in the poppet valve engine so that, with a rotary valve, combustible mixture introduced through the inlet port 7*a* to the combustion chamber does not appreciably enter the exhaust tract and the exhaust gases thus contain substantially no unburnt fuel. Conversely, in the poppet valve engine combustible mixture introduced through the inlet port 19 tends to flow, as shown by the arrows, towards the exhaust port 20 to an appreciable extent. The opening and closing of the ports of a rotary valve is very much faster than for poppet valves, as can be seen from a consideration of FIG. 13. This Figure is a plot of the valve opening percent (V%) against crankshaft rotation in degrees (C°), and because of the faster rate of operation of a rotary valve, the overlap associated therewith (period $\alpha$) is very much shorter than the overlap (period $\beta$) for poppet valves about the top dead centre position ($\gamma$) of the piston.

Figure 14:
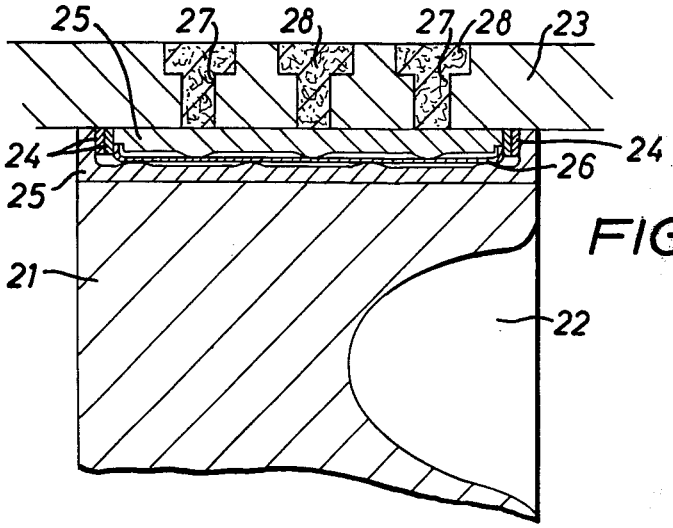
FIG. 14 shows a part of a rotary valve provided with seals.
Figure 15:
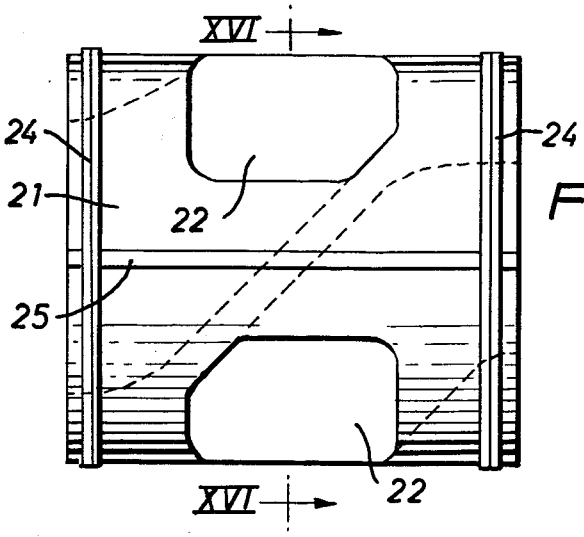
FIG. 15 is an elevation of the rotary valve member shown in part of FIG. 14.
Figure 16:
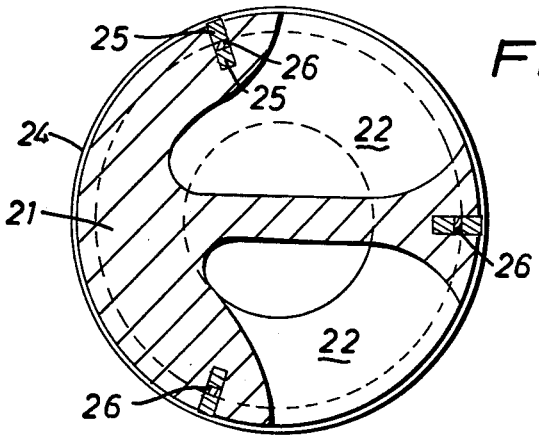
FIG. 16 is a cross-section taken on the line XVI—XVI on FIG. 15.

FIGS. 14 to 16 show an alternative manner of sealing a cylindrical rotary valve in which a valve member 21, provided with valve ports 22, is located within a housing 23. The valve member 21 is provided with circumferential sealing rings 24 and sealing strips 25 extending parallel to its axis. Each sealing strip 25 is in two parts, resiliently urged apart by spring blades 26 therebetween. The valve housing is bored, or tapped, as shown at 27, and provided with porous plugs 28 through which lubricant is supplied to the cylindrical surface of the valve member 21. Alternatively, oil may be delivered to the valve member by capillarity.

Figure 17:
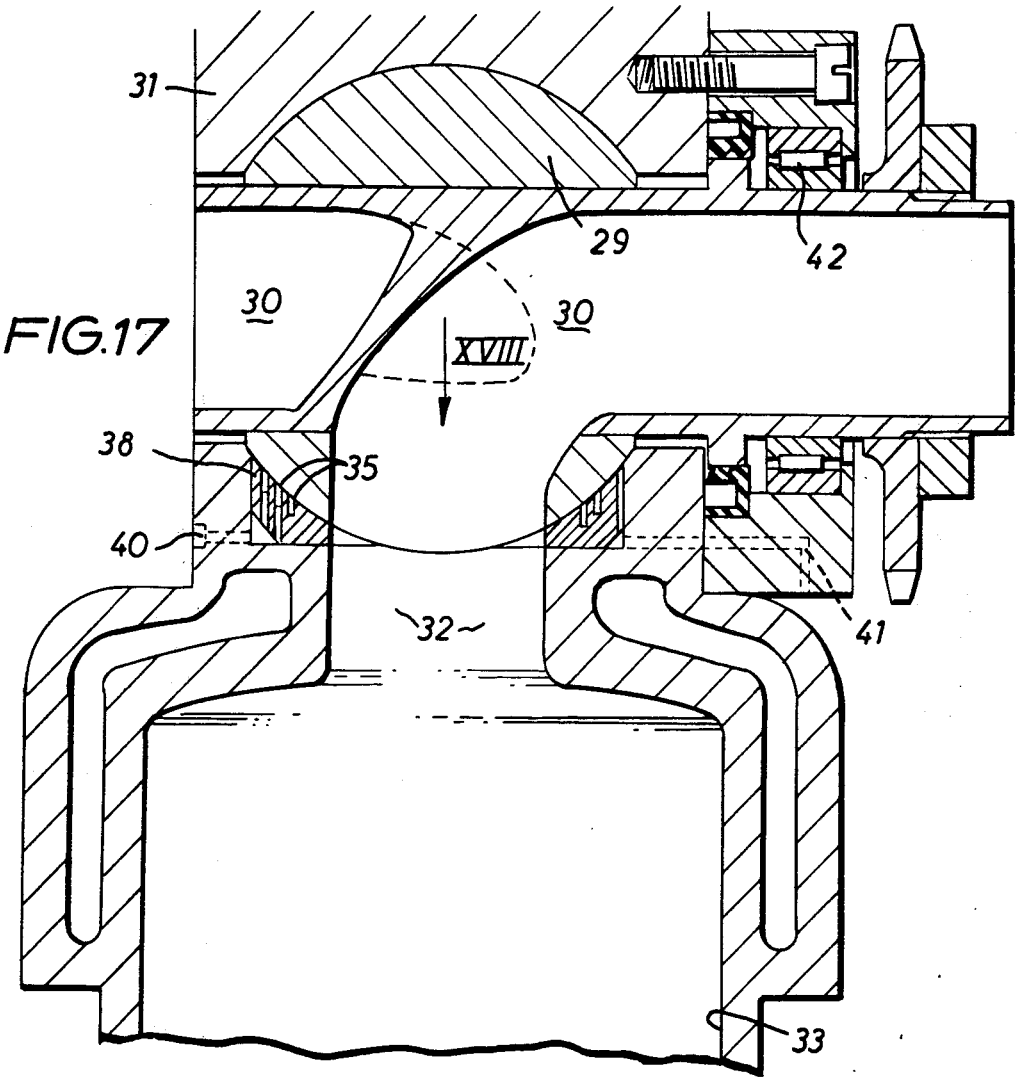
FIG. 17 is a vertical section depicting a part spherical rotary valve provided with a volute seal.
Figure 18:
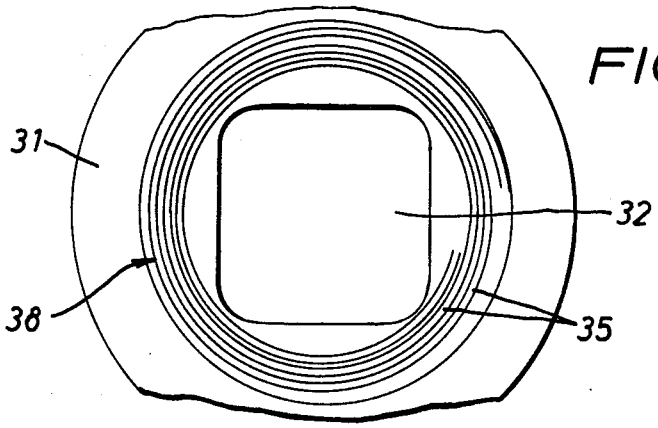
FIG. 18 is a view on arrow XVIII on FIG. 17, but with the rotary valve member removed, and showing the volute seal.

FIG. 17 shows a form of reciprocating piston engine employing a part-spherical valve member 29 rotatably mounted, by means of bearing 42, in a suitably shaped housing 31. The valve member 29 has ports 30 which comes into and out of communication with an opening 32 in the housing as the member rotates, to allow the inlet to and exhaust from the combustion chamber 33. The opening 32 to the combustion chamber is of square section, as shown in FIG. 18, but other shapes could be used. A seal around the opening 32, with the valve member 29, is effected by a grooved insert 38 fitted into a recess provided around the opening. This insert 38 is provided with a spiral groove 35, which serves to effect the seal, the depth of the groove being normal to the axis of rotation of the valve member. The grooves could be inclined to, or even parallel to, the axis of rotation if desired.

Oil supply and drainage passageways, such as those shown at 40 and 41, can be provided, as required.

Figure 19:
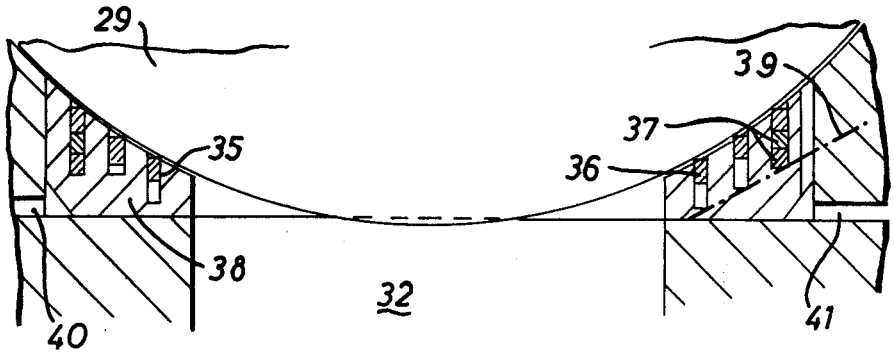
FIG. 19 is a sectional view of one arrangement of a volute seal.

FIG. 19 shows an alternative form of seal, in which a continuous seal strip 36 is located in the spiral groove 35, which strip 36 bears on the spherical face of the rotary valve member 29. Packing strips 37 are provided below the seal strip 36 as necessary to adjust the height of the seal strip so that it upstands above the face of the insert 38 by an appropriate amount. As shown at 39, the bottoms of the sealing grooves may be arranged tangentially to the periphery of the valve member 29, to avoid complex machining operations.

Figure 20:
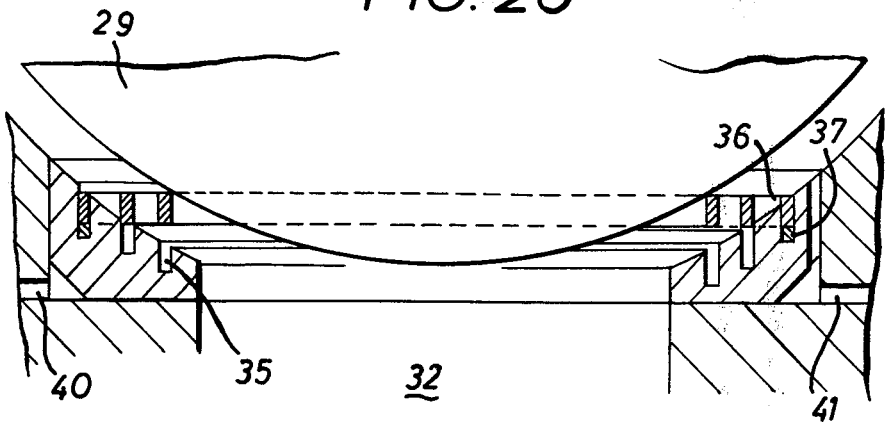
FIG. 20 is a sectional view showing a modified arrangement of a volute seal during assembly.

The seal strip 36 may be resilient, and when relaxed, generally co-planar, as shown in FIG. 20. Then, as the spherical valve member 29 is pressed into position closely adjacent the insert 38, the seal strip will be resiliently deformed — to take up the shape shown in FIG. 19. Again, packing strips 37 may be provided as necessary, and in particular to support the outer turns of the strip.

Figure 21:
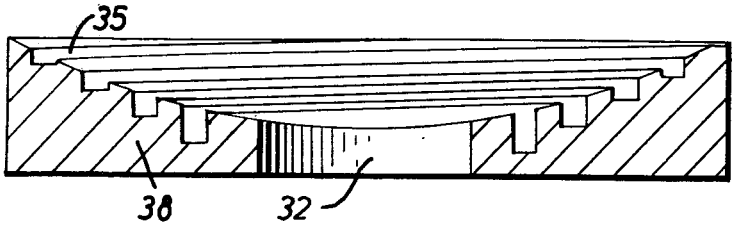
FIG. 21 is a sectional view on a further embodiment of seal.

FIG. 21 shows a further form of spiral groove 35 in an insert 38, in which the depth of the groove varies along its length, from a maximum nearest the centre (i.e. opening 32) to a minimum at its other end. Such a groove provides a spiral or leakage path, serving both to allow the spherical valve member to be sealed against the insert, and to drain removed oil.

Figure 22:
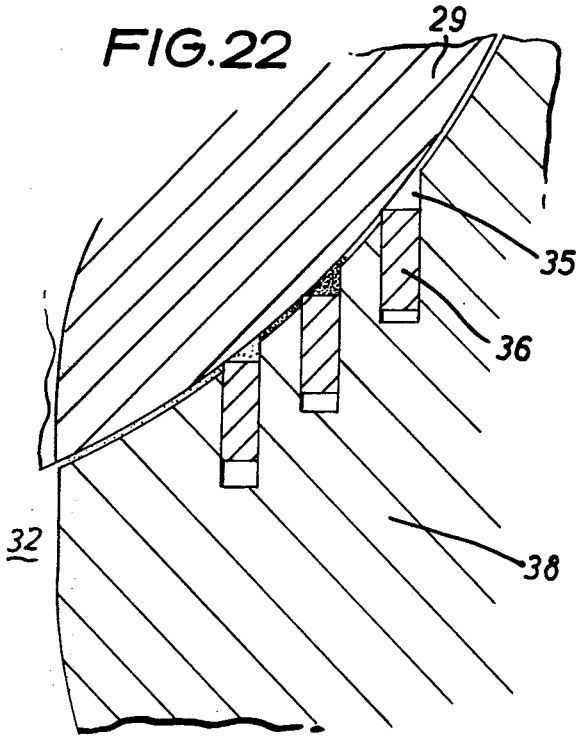
FIG. 22 is a detail showing the leakage of oil in a volute seal.

FIG. 22 is an enlarged view of an insert 38 fitted in a valve housing, the insert having a groove 35 in the form of a volute, and there being a sealing strip 36 fitted therein. The sealing strip is formed as shown, to provide a relatively sharp edge bearing against the valve member, both to effect a seal and to remove excess lubricant, the removed lubricant being able to collect as shown and then drain away.

FIGS. 23 to 28 show an improved method of effecting lubrication of the rotary valve member, permitting copious lubrication with significant cooling over its greater part, and yet allowing the removal of excess lubricant from the valve member before it passes over the opening to the combustion chamber. Referring to the drawings, 43 is a rotary valve member adapted to rotate in the direction shown in a housing 44, controlling through inlet and outlet ports 45, the inlet to and exhaust from a combustion chamber 46 at the top of a cylinder 51, in which a piston 52, actuated by a connecting rod 53, is adapted to reciprocate. Lubricating oil is delivered to the rotary valve member 43 at 47 (see FIG. 28) and removed by a scraper device 48 provided with a scraper blade 49 urged against the valve member 43 by springs 50. (In the arrangement shown in FIGS. 23 and 26, the valve member is indicated as rotating normally in a clockwise direction, whilst in FIG. 28 the valve member is shown as rotating normally anti-clockwise).

Figure 25:
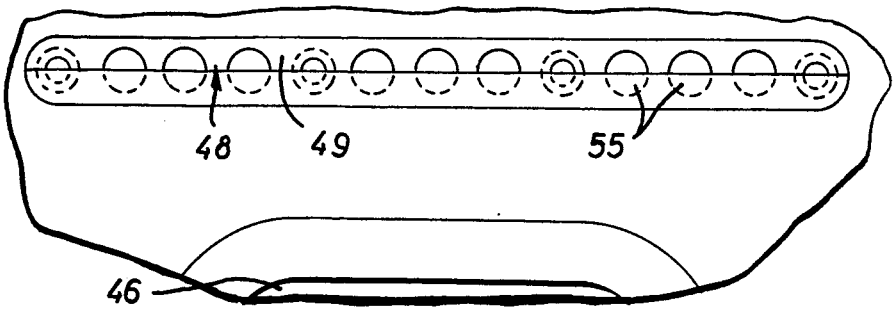
FIG. 25 is a view on arrow XXV on FIG. 24, but with the rotary valve member removed.
Figure 26:
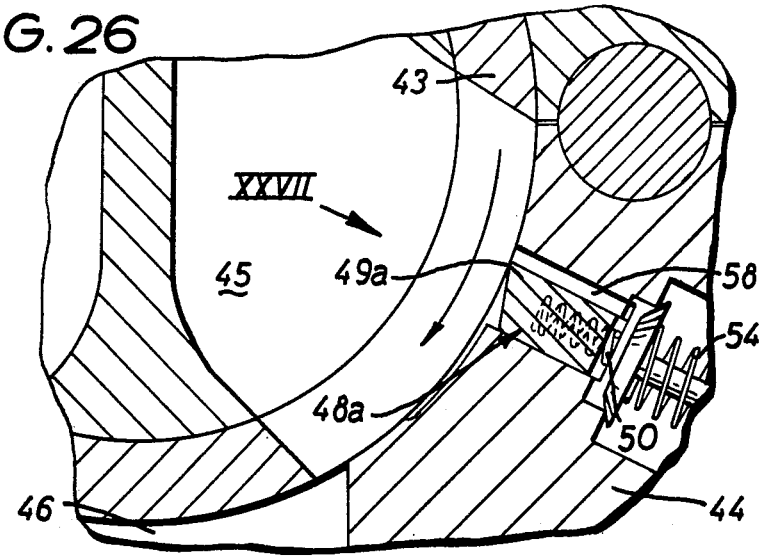
FIG. 26 is a section of part of a rotary valve provided with an alternative form of scraper device.

Referring to FIGS. 23, 24 and 25, the scraper device 48 has a scraper blade 49 urged into contact with the cylindrical surface of the rotary valve member 43 by springs 50. The edge of the scraper blade 49 is cut away to provide a slot 57 in communication with holes 55 formed in the blade 49. Lubricant removed from the valve member 43 by the blade 49 collects in the slot 57, enters holes 55 and drains into passage 56 through a non-return valve 54.

Figure 27:
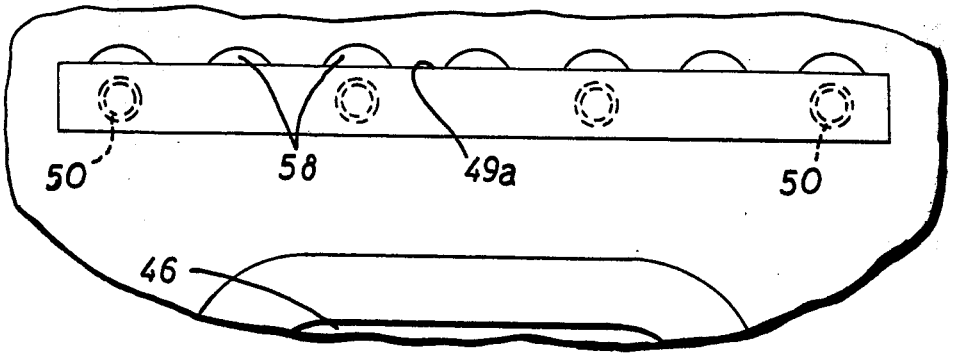
FIG. 27 is a view on arrow XXVII on FIG. 26, but with the rotary valve removed.
Figure 28:
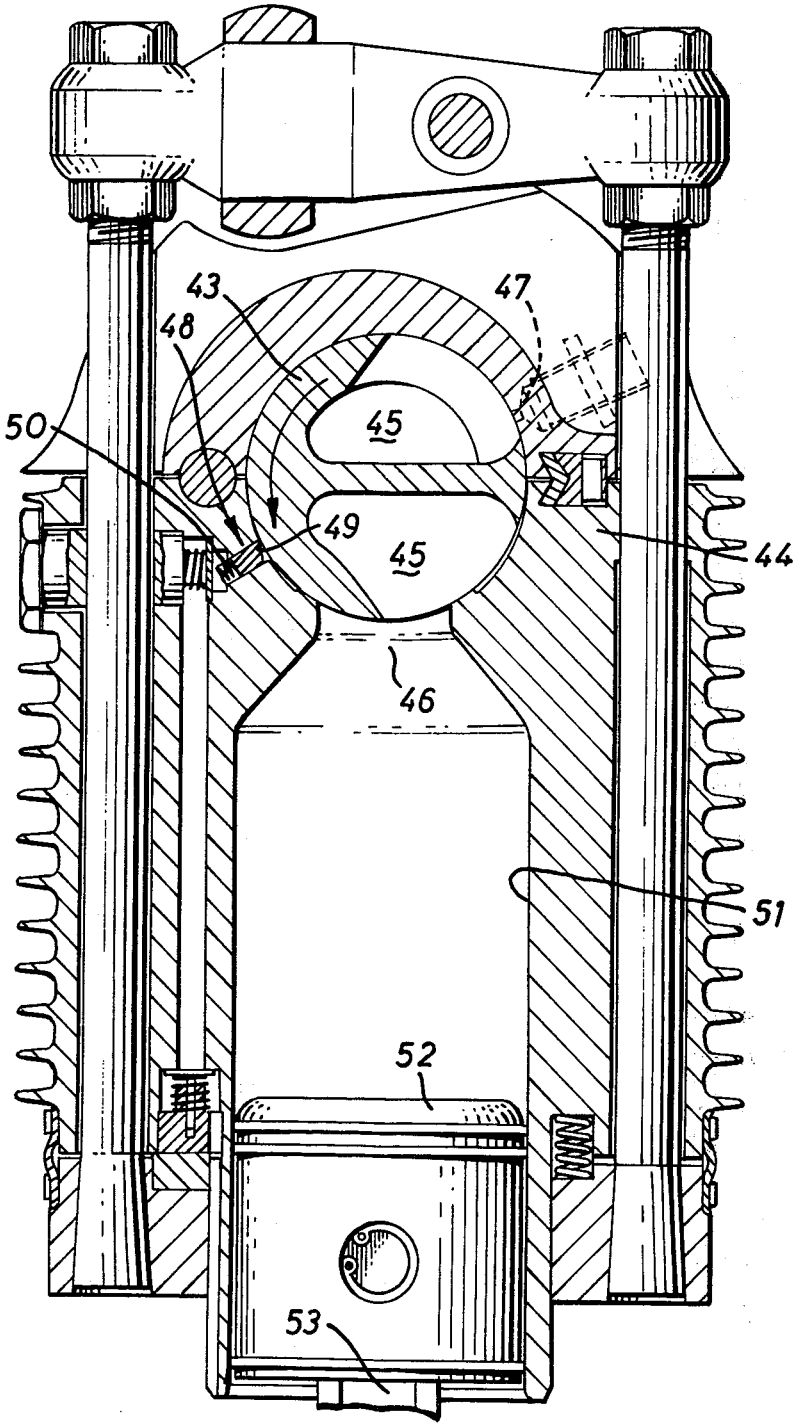
FIG. 28 is a vertical section through part of an engine equipped with a rotary valve having a scraper device.

FIGS. 26 and 27 show an alternative form of scraper device 48*a*, the rotation of the valve member 43 in FIG. 26 again being clockwise. The scraper blade 49*a* of the device 48*a* is located in a slot in housing 44 and is biassed into contact with the valve member 43 by springs 50. The slot is provided with grooves 58, through which lubricant removed from the valve member 43 may drain to the non-return valve 54.

The scraper blade 49 (or 49*a*) may be formed of any material having good wear and bearing qualities against the rotary valve member; e.g. the scraper blade may be of bronze and the rotary valve member of hardened steel or hard iron. The axial extent of the scraper blade must be greater than that of the ports 45, and hence when the ports are passing the scraper device, the scraper blade is supported only at its ends. It is necessary therefore for the blade to be rigid, so as to prevent the blade being deflected into the ports, and it is found that the rigidity of the blade coupled with the force exerted by the springs 50 should be such that the blade is deflected by not more than 1/3000 of the valve member diameter when the blade and a port are in register.

Desirably, the total volume for air within the slot in which the blade is located and on the valve member side of the non-return valve 54 is maintained as small as possible consistent with the effective draining of lubricant scraped off by the blade. This is because air in these spaces will expand as the inlet port arrives at the scraper device (since the inlet pressure normally will be subatmospheric), whereas these spaces will be charged with air at superatmospheric pressure when the exhaust port arrives thereat. The expanding air will tend to carry into the inlet port some of the lubricant removed by the scraper blade; thus the smaller the free volume in the region of the scraper device the less will be this tendency. This requirement, however, must be reconciled by the need for the scraper device to be able to drain away the removed lubricant sufficiently rapidly to prevent it building up as a pressurised film at the scraping edge which could allow the rotating valve member to carry lubricant past the scraper blade. If there is a thick film of lubricant on the valve member in the region of the opening into the combustion chamber, the pressures there developed can cause problems such as vibration of the valve member.

It is found that the lubricant removal should be sufficiently effective to produce a very thin oil film on the valve member between the scraper blade and the delivery means 47 if these problems are to be avoided. Such thin films fall within the theory of elastohydrodynamic lubrication, and the formula derived by Dowson and Higgenson (set out below) is found to apply. From this formula, a value for $H_{min}$ can be calculated, and for the diameters of valve members which are used in this invention, the actual minimum oil film thickness present on the valve member after scraping should be of the order of 40 to 50$\mu$ inches, (i.e. 1.00 to 1.25$\mu$ m).

The formula of Dowson and Higgenson, set out in "Elastohydrodynamic Lubrication", published by Pergamon Press, 1966, is as follows:

$$H_{min} = 2.65 \frac{U^{0.70} \times G^{0.57}}{W^{0.13}}$$

where $H$ = dimensionless oil film thickness parameter = h/R
$W$ = w/E'R) = dimensionless load parameter
$U$ = ($\eta$ou)/(E'R) = dimensionless speed parameter
$G$ = $\alpha$E' = dimensionless materials parameter
$h$ = actual film thickness
$R$ = radius of rotor
$w$ = load/unit width
$E'$ = Youngs modulus of housing material in the region of the thin film
$u$ = sliding velocity between rotor and housing
$\eta$o = viscosity of lubricant
$\alpha$ = pressure exponent of viscosity to take account of changes in viscosity of the lubricant caused by the high pressures prevailing.

In operation of this invention, as described, lubricant is delivered to the valve member at 47 and is carried around by the rotation of the valve member 43 to the scraper device 48 (or 48*a*) whereat it is substantially removed before it can reach the combustion chamber. The removed oil passes via the non-return valve 54 and passage 56 to its source (and typically the engine sump) whence it can be recirculated to the valve at 47. It will be appreciated that the lubricant will cool the valve as well as lubricate it, and for the former purpose it is desirable for there to be a high flow rate over the valve.

Figure 29:
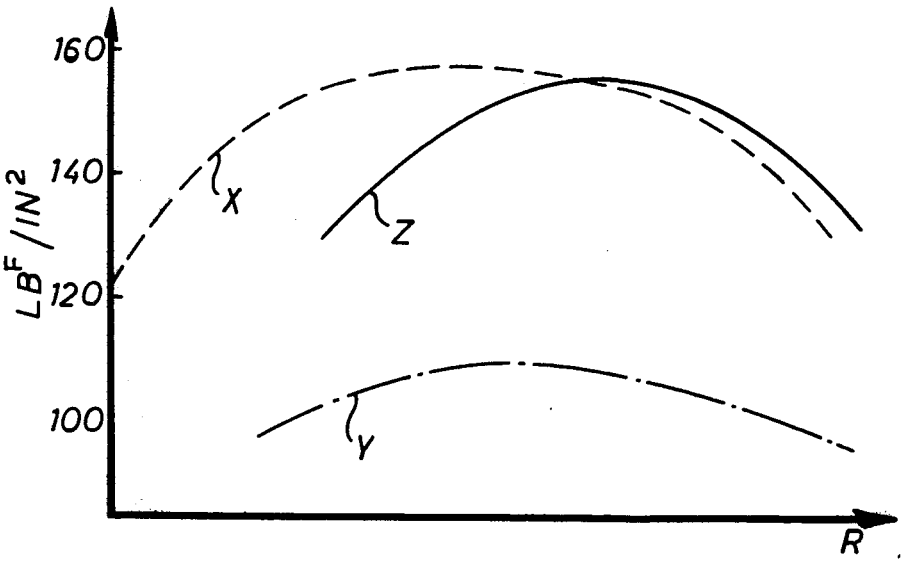
FIG. 29 is a graph showing comparative performances of two reciprocating piston engines, one equipped with poppet valves and one with a rotary valve, and a third engine being constructed as a rotary engine.

In order to illustrate the effects obtainable by the various features of this invention, reference is made to FIG. 29. Here, the relative, full-throttle performance of three engines is compared by plotting the crankshaft rotational speed, R, of the engines against their mean effective pressure, in lbs-force/square inch. Curve X relates to a conventional four cylinder, in line, push-rod operated poppet valve engine, running on 100 octane petrol, curve Y relates to a form of Wankel rotary engine, also running on 100 octane petrol, and curve Z relates to an engine incorporating a rotary valve constructed in accordance with certain preferred features of this invention, and running on 66 octane petrol.

What is claimed is:

1. A method of enhancing the performance of an internal combustion engine which includes a rotary valve for controlling the inlet of combustible mixture to and the exhaust of combustion products from the combustion chamber of an engine, which rotary valve comprises a valve housing, an opening in the valve housing communicating with the combustion chamber, a valve member rotatably mounted within the housing, a port within the valve member which comes into and out of registration with the said opening as the valve member rotates, said method comprising the steps of rotating the valve member in a timed relationship to the engine, supplying a copious amount of lubricant to the interface between the valve member and the valve housing at a location after rotation of the valve member past the opening to lubricate and cool the valve, removing excess lubricant from the valve member before said member passes over the opening to an extent that leaves on the valve member a film of lubricant of from 40 to 50$\mu$ inches by rotating the valve member past a rigid scraper blade held in the valve housing, said scraper blade being of axial extent greater than that of the valve port and resiliently biased towards the surface of the rotatable valve member, such that the magnitude of the resilient bias coupled with the rigidity of the scraper blade produces a deformity of the scraper blade of not more than 1/3000 of the diameter of the valve when the valve port and the scraper blade are in register whereby the said film of lubricant of from 40 to 50$\mu$ inches results, which film serves to seal the valve member to the housing around the said opening, scraped off lubricant being removed through a passage in the housing and through one or more non-return valves located in the said passage providing an area of reduced pressure to assist in the drainage of lubricant removed by the scraper blade.

2. A method according to claim 1 including the further step of providing non-resilient sealing lips upstanding around the opening in the valve housing and sloping away therefrom to enhance the seal against the valve member, the width of the seals being selected to obtain a sealing pressure thereon of from 500 to 1000 p.s.i.

3. A method according to claim 1 including the further steps of forming the valve housing in two parts, hinging said parts together with the opening being clamped to the one part and the cylinder being spring urged towards the other part, selecting the hinge point connecting the two parts to provide a force of at least 8% greater than the force generated by combustion in the combustion chamber, thereby urging the valve back on its seat and maintaining contact between the valve member and the valve sealing means.

* * * * *